United States Patent [19]

Mooney

[11] Patent Number: 4,592,386

[45] Date of Patent: Jun. 3, 1986

[54] TANK OVERFILL PROTECTION MEANS

[76] Inventor: Joseph R. Mooney, 33 Hawk St., New Orleans, La. 70124

[21] Appl. No.: 744,025

[22] Filed: Jun. 12, 1985

[51] Int. Cl.[4] ..... F16K 24/00; B65B 31/00

[52] U.S. Cl. ..... 137/588; 137/592; 141/59; 141/290

[58] Field of Search ..... 137/572, 588, 589, 592; 141/59, 290, 302, 308

[56] References Cited

U.S. PATENT DOCUMENTS

| | | | |
|---|---|---|---|
| 1,968,141 | 7/1934 | Green | 141/290 |
| 3,840,056 | 10/1974 | Bower | 141/59 |
| 3,863,688 | 2/1975 | Millar et al. | 141/59 |
| 3,908,718 | 9/1975 | Bower | 137/588 |
| 4,009,739 | 3/1977 | Weatherford | 141/59 |
| 4,260,000 | 4/1981 | McGahey et al. | 141/290 |

*Primary Examiner*—A. Michael Chambers

*Attorney, Agent, or Firm*—Walker & McKenzie

[57] ABSTRACT

An underground liquid storage tank that limits the filling of the tank to prevent it from being completely filled and to prevent spills from occurring when the tank is filled. The tank includes, in general, a hollow body having a plurality of standard openings through the top thereof for a fill pipe, a vent line, vapor recovery piping, pump system, gauges, etc. A cylindrical skirt is located within the interior of the body conterminous with each of the standard openings to cause an air "pocket" to be left in the top of the hollow body when the tank is filled.

3 Claims, 4 Drawing Figures

TANK OVERFILL PROTECTION MEANS

BACKGROUND OF THE INVENTION

1. Field of the Invention

The present invention relates, in general, to liquid storage tanks and more specifically to means for preventing overfill spills in underground liquid storage tanks.

2. Description of the Prior Art

A common problem in filling liquid storage tanks, particularly in the filling of underground tanks in petroleum fueling facilities when product is discharged from aboveground tank trucks, is the spilling of some product, usually relatively small amounts, e.g., 5–10 gallons.

Such spilling can occur if the underground tank is completely filled and there is still product left in the tank truck. Product will rise in the vent pipe of the tank (and the vapor recovery line—if one is used), and the tank truck fill hose will also be full of product.

When the tank truck fill hose is disconnected from the underground tank fill pipe, unless "dry break" fittings are used on the hose and on the fill pipe, enen though the truck valve has been closed, product in the hose will spill out into the fill pipe manhole opening, and product in the vent pipe and/or vapor recovery lines will "seek its level" and drop down to an elevation equal to that of the top of the underground tank fill pipe, spilling product out over the top of the fill pipe into the fill pipe manhole opening.

Prior methods of preventing such spills include allowing only a limited, pre-determined meterd flow of liquid into the tank (the exact amount needed is very difficult to determine) and the use of "dry break" fittings (such fittings leave a dangerous quantity of liquid in the tank truck fill hose).

SUMMARY OF THE INVENTION

The basic concept of the present invention is to prevent such spills from occurring by limiting the filling of the tank, not allowing it to be completely filled, trapping air and vapor in the top of the tank and, after the tank truck valve has been closed, releasing the air/vapor through a valve controlled opening, that opening being hose-connected to a vent line, or to a vapor recovery line, at a height preferably above the level of product which might have risen into such a line, or lines, thus allowing the liquid which has risen into the vent and/or vapor recovery line(s) to flow back into the tank, raising the level of product in the tank slightly but still leving it "underfilled".

The product remaining in the tank truck fill hose may be "trapped" by a vacuum condition, particularly in the usual type installation in which a "drop-tube" is used. Therefore, a connection from the fill pipe to the abovementioned line leading from the "controlled" opening is to be an additional feature of the system. This additional line connection is also to have a valve for control purposes.

The improved liquid storge tank of the present invention comprises, in general, a hollow body member, a fill pipe attached to the body member, a vent pipe or line attached to the body member, and air trap means operatively coupled to the fill pipe and vent line and mounted within the interior of the body member for preventing the body member from being completely filled with product through the fill pipe.

DESCRIPTION OF THE PREFERRED EMBODIMENT

Figure 2:
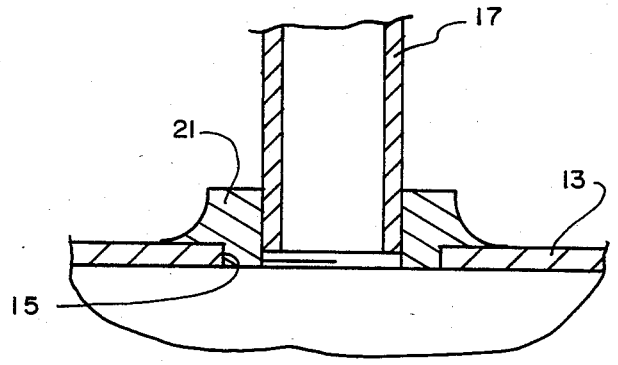
FIG. 2 (PRIOR ART)
FIG. 2 is a sectional view of a portion of a prior art liquid storage tank.

The improved liquid storage tank 11 of the present invention is especially adapted for use in the petroleum industry as an underground liquid storage tank for service stations and the like. The tank 11 may be basically of any typical construction well known to those skilled in the art. Thus, for example, the tank 11 may include a hollow, barrel-like body member 13 having a hollow interior 14 including an upper wall portion forming the apex A of the interior 14. The body member 13 of a typical underground storage tank 11 as used in the petroleum industry normally has a plurality of spaced-apart apertures 15 through the top or apex A thereof communicating with the interior 14 thereof for coacting with various components such as a typical fill pipe 17, a vent line 18 (which normally runs underground from the tank 11 usually to the side of a service station building B and then up to a height of 3 or 4 feet above the top of the building B), a suction or submersible pump piping (not shown), manhole access structure 19 which may be provided to allow access into the interior of the tank 11, vapor recovery system structure including a vapor recovery pipe 20 (for convenience to the tank truck driver, the vapor recovery pipe 20 is usually adjacent the fill pipe 17), inventory monitoring devices (not shown), or the like. The specific number of spacing and size of the apertures 15 may vary as will be apparent to those skilled in the art. The apertures 15 for coacting with the fill pipe structure and the like may be sized to receive a fitting having a 4 inch diameter threaded aperture while the aperture 15 for coacting with the manhole access structure 19 may have a 24 inch or greater diameter. In a relatively large tank 13 (e.g., 26 feet long), the apertures 15 may be as much as 6 feet apart. A typical prior art fitting 21 is shown in FIG. 2 welded to an aperture 15 for threadingly receiving a fill pipe 17 or the like.

Figure 3:
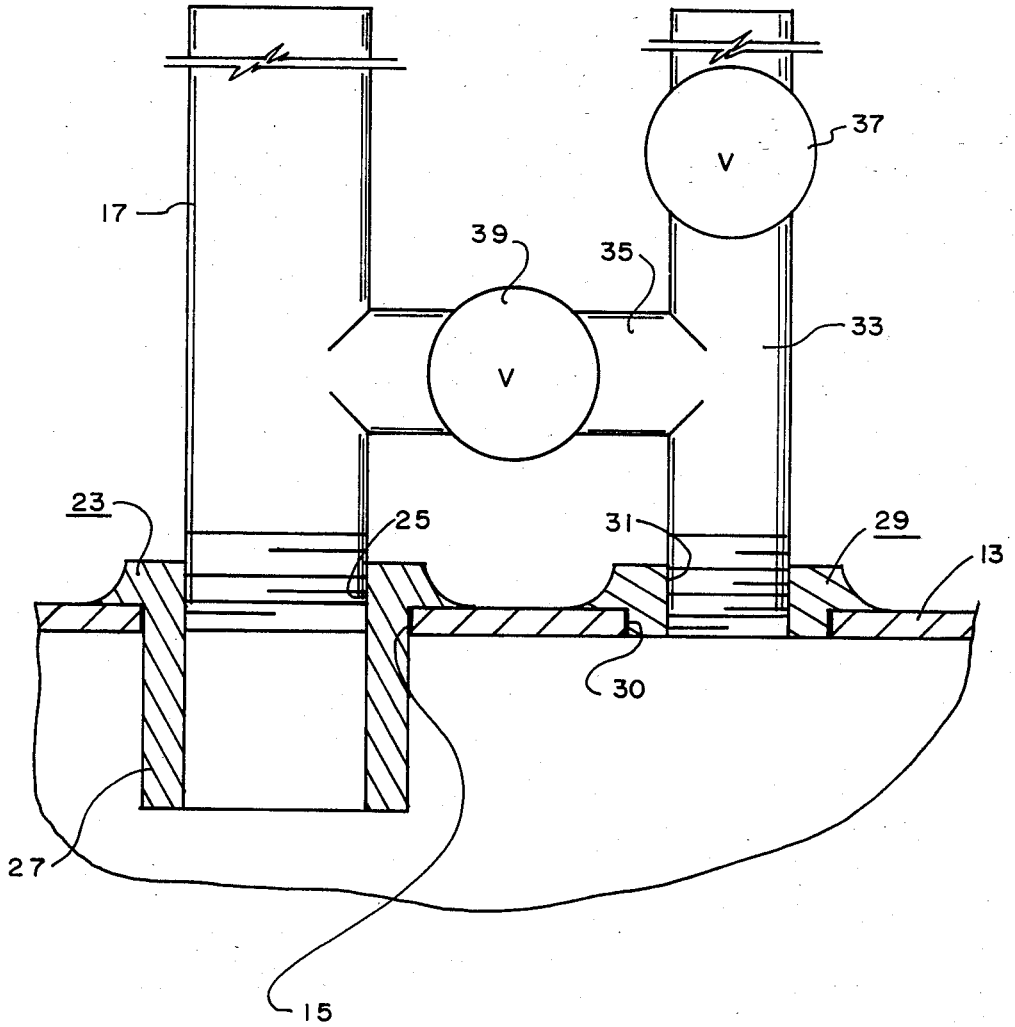
FIG. 3 is a sectional view of a portion of the improved liquid storage tank of the present invention.

The preferred embodiment of the present invention prevents overfill spills of product when the tank 11 is being filled by providing cylindrically-shaped interior skirt members about each aperture 15, protruding inward and downward a short distance from the top of the body member 13 within the interior thereof, which will cause an air/vapor "pocket" to be left in the top of the interior of the body member 13 when the tank 11 is filled. The skirt members coact to define air trap means operatively coupled preferably adjacent each standard aperture 15 and mounted within the interior 14 of the body member 13 for preventing the body member 13 from being completely filled with liquid through the fill pipe 17. Thus, the tank 11 of the present invention is preferably provided with unique fitting means 23 (see FIGS. 3 and 4) for being welded to the apertures 15 in place of the typical fittings 21.

The fitting means 23 is similar to the typical fitting 21 in that it typically has a threaded opening 25 for threadingly receiving a fill pipe 17 or the like nd is normally welded to the body member 13 conterminous with an aperture 15. However, the fitting means 23 is unique in that it includes a downwardly extending, cylindrically-shaped skirt 27 protruding inward and downward a short distance, such as, for example, four inches (101.6 mm) from the top of the body member 13. The fitting means 23 may be constructed in any manner apparent to those skilled in the art. Thus, for example, the fitting means may be machined as a one-piece unit out of metal. On the other hand, the fitting means 23 may consist of a typical fitting such as the fitting 21 with a length of pipe or the like welded to the lower end thereof to define the skirt 27. It will be noted that the size of the fitting means 23 will depend on the size of the apertures 15. Thus, while the typical fitting means 23 may have a skirt 27 with a roughly 4 inch diameter, the skirt 27 used in conjunction with the manhole structure 19 may have a diameter of roughly 24 inches.

It is not absolutely necessary that all tank openings or apertures 15 have the unique fitting means 23 with the downwardly protruding cylinder or skirt 27. That is, the aperture 15 which is to be used for pump suction systems or for submersible pump insertion need not in all cases have this feature.

However, inasmuch as it is rarely known in advance just which opening or aperture 15 is to be used for a specific purpose (i.e., fill, vent, pump, vapor recovery, etc.) and because of the very low cost of the fitting means 23, it is preferred that all openings or apertures 15 be provided with the unique fitting means 23.

Figure 4:
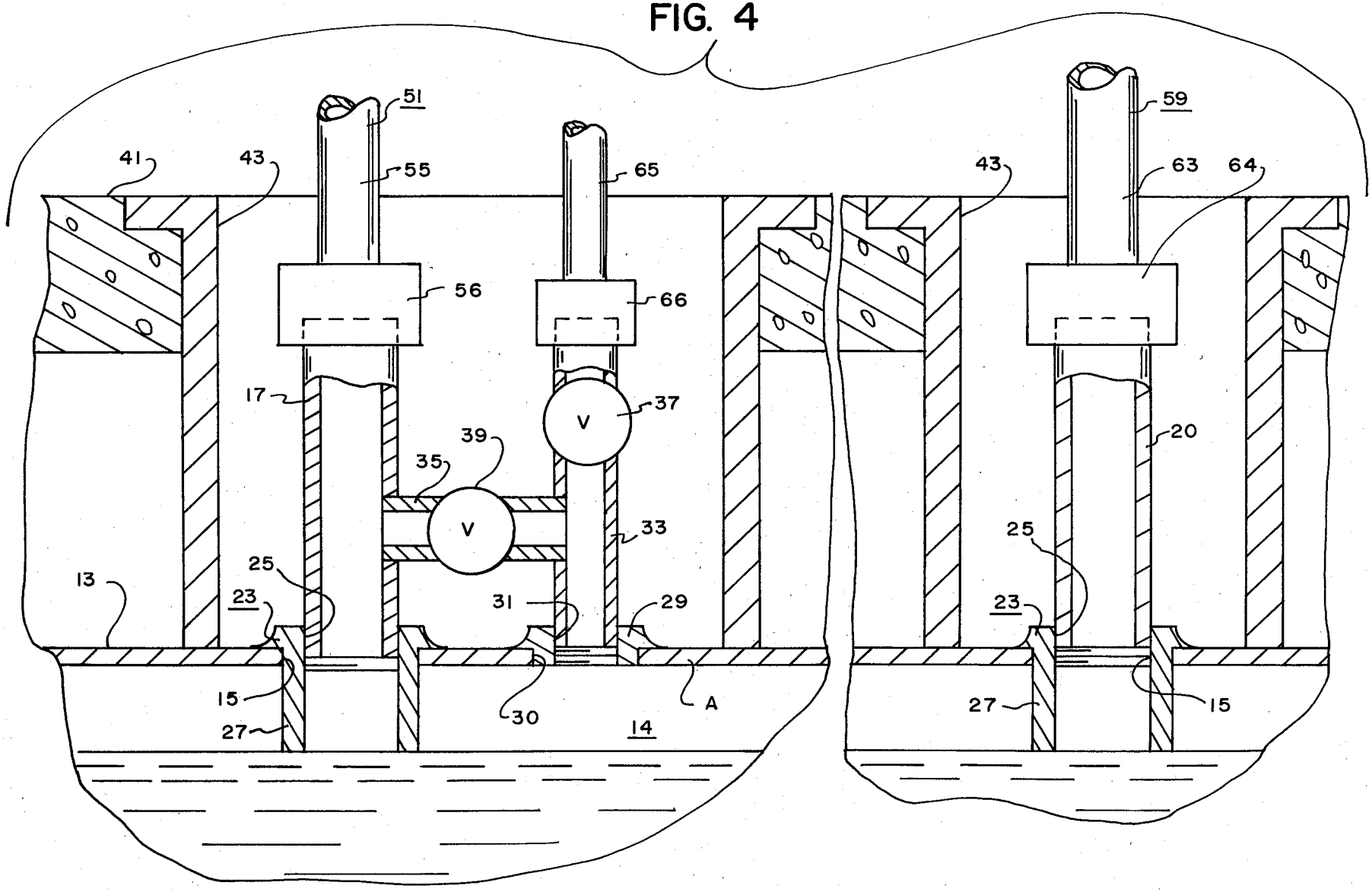
FIG. 4 is a sectional view similar to FIG. 3 but showing associated structure.

The tank 11 of the present invention also preferably includes a unique vent fitting means 29 for being welded conterminous with an aperture 30 provided through the body member 13 adjacent the aperture 15 and the fitting mens 23 receiving the fill pipe 17 (see, in general, FIG. 4). The vent fitting means 29 may be substantially like the prior art fitting 21 with the exception that the vent fitting means 29 has a relatively small threaded bore 31 therethrough for threadingly receiving a bleeder vent pipe 33. Thus, for example, the threaded bore 25 of the fitting means 23 and the threaded bore of the prior art fitting 21 may have a four inch (101.6 mm) diameter while the threaded bore 31 may have a one inch (25.4 mm) diameter. It is not absolutely necessary that all standard tank openings or apertures 15 have a companion aperture 30 and vent fitting means 29. However, for the reasons given above relative to the fitting means 23 (e.g., because it is not normally known in advance which aperture 15 will receive the fill pipe 17 and due to the low cost of the vent fitting means 29), it is suggested that all apertures 15 be provided with a fitting means 23 and a companion aperture 30 and vent fitting means 29. Note: In FIG. 4 only the fitting means 23 associated with the fill pipe 17 is provided with a companion vent fitting means 29. Thus, while in actual practice for location convenience sake, a vent fitting means 29 will be provided adjacent each aperture 15, only one vent fitting means 29 will actually be used, that being the one closest to the aperture 15 used for the fill pipe 17. The bore 31 through the fitting means 29 that are not used for receiving a bleeder vent pipe 33, etc. are closed by way of a typical plug or the like (not shown) as will be apparent to those skilled in the art.

The tank 11 of the present invention preferably includes a crossover pipe 35 extending between the bleeder vent pipe 33 and the fill pipe 17 to allow fluid to pass therebetween in a manner which will hereinafter be discussed.

The tank 11 preferably includes a first valve means 37 positioned in the bleeder vent pipe 33 above the crossover pipe 35 and a second valve means 39 located in the crossover pipe 35 between the bleeder vent pipe 33 and the fill pipe 17. The first and second valve means 37, 39 preferably consists of typical manual valves for allowing the bleeder vent pipe 33 and crossover pipe 35 to be selectively opened and closed for reasons which will hereinafter become apparent.

The fill pipe 17, vapor recovery pipe 20, bleeder vent pipe 33 and crossover pipe 35 are preferably located beneath the surface 41 of the ground and access thereto and to the first and second valve means 37, 39 is through typical manholes 43 normally covered by typical manhole covers 45 as will be apparent to those skilled in the art.

Figure 1:
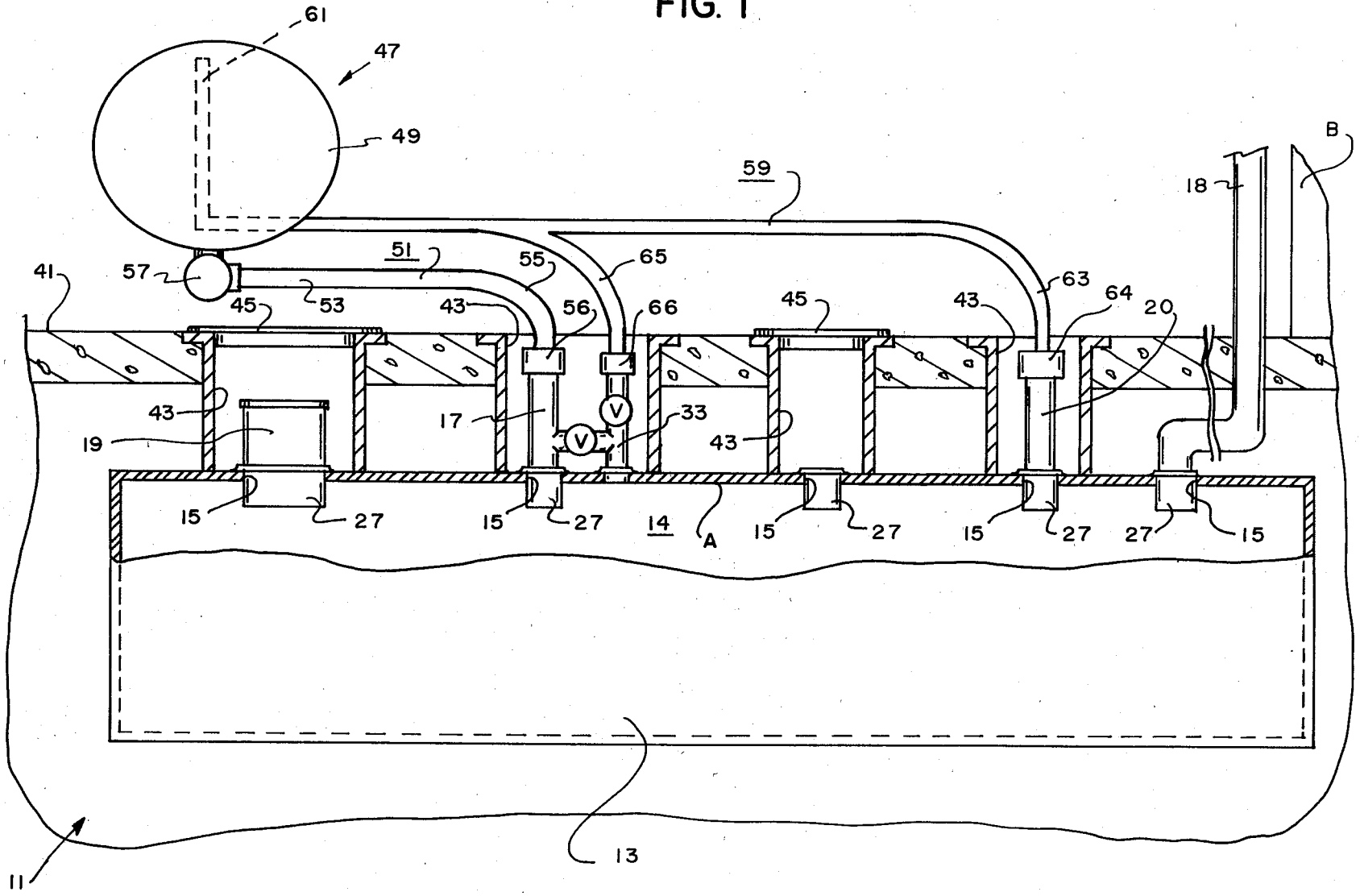
FIG. 1 is a somewhat diagrammatic view of the improved liquid storage tank of the present invention and associated structure.

A typical tank truck 47 (diagrammatically shown in FIG. 1) is used to fill the tank 11 with fluid. The tank truck 47 includes a tank 49 for holding a quantity of product, product delivery or fill hose 51 having a first end 53 coupled to the tank 49 and having a second end 55 for being coupled to the fill pipe 17 by a typical connector 56 or the like, and a nozzle/valve 57 typically provided at the first end 53 of the product delivery hose 51 for controlling the flow of product from the tank 49 through the product delivery hose 51. The tank truck 47 may also include a vapor return or vent hose 59 having a first end 61 coupled to the tank 49 in communication with the interior thereof and having a second end 63 for being coupled to the vapor recovery pipe 20 by a typical connector 64 or the like to allow vapor from the body member 13 to flow into the tank 49 when the tank truck 47 is filling the tank 11 for reasons and in a manner now apparent to those skilled in the art. The improvement of the present invention preferably includes a bleeder hose 65 for being coupled to the bleeder vent pipe 33 by a typical connector 66 or the like to allow vapor from the body member 13 to exit the body member 13 as will hereinafter become apparent. Thus, the bleeder hose 65 may be attached to and may communicate with the vapor return hose 59 as shown in FIG. 1 to allow vapor from the body member 13 to flow into the tank 49 or may be connected to the vent line 18 at a point above grade (e.g., 6 feet above grade) to allow vapor from the body member 13 to exit the interior thereof through the vent line 18 as will now be apparent to those skilled in the art. It should be noted that the vapor return hose 59 may be of the "two-point" system as shown in FIGS. 1 and 4 or of the coaxial system for being associated with the fill pipe 17, etc., as will be apparent to those skilled in the art.

The preferred tank filling sequence of operation using the tank 11 of the present invention is as follows:

1. The driver of the tank truck 47 gauges the tank 11, connects the fill hose 51 to truck nozzle/valve 57, etc.

2. The driver connects the fill hose 51 via connector 56 to the fill pipe 17 and connects the vapor return hose 59 via connector 64 to the mating vapor return riser or vapor recovery pipe 20 of the tank 11, etc.

3. The driver connects vapor/air bleeder hose 65 via connector 66 to bleeder vent pipe 33 and to the vapor return hose 59 (or to the vent line 18 if the vapor return hose 59 is not being used in pipieng system).

4. The driver opens truck tank nozzle/valve 57 and product flows from the tank 49 into the body member 13. The driver may allow a limited, pre-determined metered volume to flow into the underground tank 11 or may allow the full contents of the tank truck 47 to flow into the underground tank 11; if, however, the level of product in the underground tank 11 reaches the bottom of the interior downwardly protruding skirts 27 of the fitting means 23 before the pre-determined metered amount flows into the tank 11, or before the contents of the tank 49 have been emptied, flow will stop due to the typical construction of the nozzle/valve 57 and/or connector 56, etc., as will now be apparent to those skilled in the art.

Note: Flow will not stop immediately, but a small amount of product will continue to flow and rise slightly above the outside of the bottoms of the interior downwardly protruding skirts 27 compressing the vapor/air "pocket" slightly and will rise up into the vent line 18, etc. (and into the vapor recovery pipe 20 and return hose 59 if such line is used in the system) because of the head pressure of the product remaining in the tank 49 of the trunk tank 47.

5. The driver closes the truck tank nozzle/valve 57.

6. The driver opens the first valve means 37 allowing compressed air/vapor in the "pocket" within the interior of the body member 13 to escape through the bleeder vent pipe 33 and into the bleeder hose 65 and vapor return hose 59 or vent line 18; any product which might have risen into the vent line 18 and/or into the vapor recovery pipe 20 and return hose 59 will drop back into the body member 13 of the underground tank 11.

7. The driver opens the second valve means 39, allowing product which may have been "trapped" in the product delivery hose 51 to flow from the hose 5 1 into the body member 13 of the underground tank 11 emptying the product delivery hose 51.

Note: It is essential that the product delivery hose 51 be emptied. It is unsafe for a tank truck 47 to haul in the truck hose racks hoses 51 which are filled with product. A basic cause of overfill "spills" which now occur is that a driver, after filling an underground tank completely, will disconnect the product delivery hose and allow the hose contents to flow into the ground around the fill pipe.

As thus constructed and used, the present invention provides a liquid storage tank that reduces the possibility of spilling product as the tank is filled. In the present invention, the standard tank openings or apertures 15 have interior members (cylindrically-shaped skirts 27) such as, e.g., pipe nipples, protruding inward and downward a short distance, e.g., four inches (101.6 mm), which will cause an air/vapor "pocket" to be left in the top of the body member 13 of the tank 11 when the tank 11 is filled. Even if there is product left in the tank truck 47 and the head pressure of the product causes some product to rise up into the vent line 18 and/or into the vapor recovery pipe 20 and vapor return hose 59, if such a system is used, there will be a "pocket" of slightly compressed air/vapor in the top of the body member 13 of the tank 11—the tank 11 will not be completely filled with product. After the filling operation has been completed and after the tank truck nozzle/valve 57 has been closed, the first valve means 37 is opened and pressurized air/vapor flows into the vent line 18 or into the vapor return hose 59 (depending on what type of piping system is being used), allowing the product which has risen into the vent line 18 and/or into the vapor recovery pipe 20 and vapor return hose 59 to drop back into the body member 13 of the tank 11. Then the second valve means 39 is opened, allowing the product "trapped" in the tank truck product delivery hose 51 to flow into the body member 13 of the tank 11 as air is admitted to the hose 51. The total volume of the additional product (from vent line 18, vapor recovery pipe 20 and return hose 59 and product delivery hose 51) is relatively small (usually not more than 20 to 40 gallons) and will result in a relatively small rise of elevation of product in the body member 13 of the underground tank 11, leaving the underground tank 11 still somewhat less than completely full.

It should be noted that most underground tanks are not installed in a perfectly level position. Even in a good quality installation, elevation from end to end of the tank may differ by as much as one inch (25.4 mm). In a poor quality installation, which should not be tolerated by oil company inspectors, the difference may be as much as two to three inches (50.8 to 76.2 mm). Any such differential will tend to offset the beneficial effect of the inwardly protruding cylinders under the tank opening. Therefore, oil companies may wish to specify the dimension of such cylinders to be greater than the four inch (101.6 mm) dimension suggested, only as an example, herein. For example, in very large, very long tanks, installed in relatively unstable soil, they may prefer to specify six inch (152.4 mm) long interior cylinders or skirts.

IMPORTANT SAFETY NOTE: In this or any other underground tank piping system, it is strongly recommended that vent lines and vapor recovery lines (if used) not be manifolded, particularly when such lines are connected to tanks containing different products. Not manifolding such lines will prevent the mixing of different types of product (e.g., different grades of gasoline or gasoline and diesel fuel) when product rises into the vent and/or vapor recovery lines during filling operations. Some existing manifolded systems use valves of the floating-ball poppet type which are intended to prevent the rising of product into the vent and/or vapor recovery lines and thus prevent the mixing of product—such systems cannot always be counted on to be reliable: The ball may stick (even slightly) in the down, or open position; foreign matter may prevent tight closing; wear over a period of time may prevent tight closing.

Although the present invention has been described and illustrated with respect to a preferred embodiment thereof and a preferred use therefore, it is not to be so limited since changes and modifications can be made therein which are within the full intended scope of the invention.

I claim:

1. An underground liquid storage tank comprising:

(a) an underground hollow body member for holding a quantity of liquid;

(b) a fill pipe attached to said body member and communicating with the interior thereof for allowing liquid to pass therethrough into the interior of said body member;

(c) a vent pipe attached to said body member and communicating with the interior thereof for allowing air to pass therethrough from the interior of said body member;

(d) air trap means mounted within the interior of said body member for preventing said body member from being completely filled with liquid through said fill pipe; said air trap means including a downwardly extending cylindrical skirt attached to said fill pipe and including a downwardly extending cylindrical skirt attached to said vent pipe;

(e) a bleeder vent pipe attached to said body member adjacent said fill pipe and communicating with the interior of said body member for allowing air to pass therethrough from the interior of said body member adjacent said skirt attached to said fill pipe;

(f) a cross over pipe extending between said bleeder vent pipe and said fill pipe for allowing fluid to pass therethrough between said fill pipe and said bleeder vent pipe and the interior of said body member;

(g) a first valve means mounted in said bleeder vent pipe for selectively closing said bleeder vent pipe, and (h) a second valve means mounted in said cross over pipe for selectively closing said cross over pipe.

2. An underground liquid storage tank for holding a quantity of liquid beneath the surface of the ground, said tank comprising:

(a) a body member located beneath the surface of the ground, said body member having a hollow interior for holding a quantity of liquid, said interior having an upper wall portion forming the apex of said interior;

(b) a fill pipe having a first end attached to said body member in communication with said interior of said body member at said upper wall portion thereof and having a second end communicating with the surface of the ground for allowing liquid to pass from the surface of the ground into said interior of said body member;

(c) a vent line having a first end attached to said body member in communication with said interior of said body member at said upper wall portion thereof and having a second end communicating with the atmosphere for allowing air to pass from said interior of said body member therethrough;

(d) skirt means attached to said upper wall portion of said body member within said interior of said body member and conterminous with said first ends of said fill pipe and said vent line for causing a quantity of air to be trapped within said interior of said body member as said body member is filled with liquid, said skirt means extending downward from said upper wall portion of said body member;

(e) a bleeder vent pipe attached to said body member adjacent said fill pipe and communicating with the interior of said body member for allowing air to pass therethrough from the interior of said body member adjacent said skirt means;

(f) a cross over pipe extending between said bleeder vent pipe and said fill pipe for allowing fluid to pass therethrough between said fill pipe and said bleeder vent pipe and the interior of said body member:

(g) a first valve means mounted in said bleeder vent pipe for selectively closing said bleeder vent pipe; and (h) a second valve means mounted in said cross over pipe for selectively closing said cross over pipe.

3. The tank of claim 2 in which said body member has a plurality of apertures through said apex thereof; and in which said skirt means includes a skirt member attached to said upper wall portion of said body member within the interior of said body member adjacent each of said apertures except said one of said apertures said bleeder valve is coupled to, each of said skirt members extending downward from said upper wall portion of said body member.

* * * * *